US010533317B2

(12) United States Patent
Glover et al.

(10) Patent No.: US 10,533,317 B2
(45) Date of Patent: Jan. 14, 2020

(54) CURTAIN WALL EXPANSION JOINT

(71) Applicant: Arconic Inc., Pittsburgh, PA (US)

(72) Inventors: Raymond Glover, Cheshire (GB); Daniel Birrell, South Tyneside (GB)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 15/962,743

(22) Filed: Apr. 25, 2018

(65) Prior Publication Data

US 2019/0330841 A1 Oct. 31, 2019

(51) Int. Cl.
*E04B 1/68* (2006.01)
*E04B 2/96* (2006.01)

(52) U.S. Cl.
CPC ..... *E04B 1/6813* (2013.01); *E04B 2/96* (2013.01)

(58) Field of Classification Search
CPC . E04B 2/96; E04B 2/965; E04B 2/967; E04B 2/88
See application file for complete search history.

(56) References Cited

U.S. PATENT DOCUMENTS 2,885,040 A * 5/1959 Grossman ..... E04B 2/96 52/207
2,914,145 A * 11/1959 Benson ..... E04B 2/96 52/235
2,963,126 A * 12/1960 Cudini ..... E04B 2/90 52/302.6
3,053,353 A * 9/1962 Miller ..... E04B 2/962 52/477
3,357,145 A * 12/1967 Grossman ..... E04B 2/965 52/235
3,522,684 A * 8/1970 Grossman ..... E04B 2/965 52/393
3,978,629 A * 9/1976 Echols, Sr. ..... E04B 2/967 52/235
4,008,552 A * 2/1977 Biebuyck ..... E04B 2/96 52/204.591
4,016,695 A * 4/1977 Stoakes ..... E04B 2/90 52/476
4,055,923 A * 11/1977 Biebuyck ..... E04B 2/96 52/235
4,584,804 A * 4/1986 Tajima ..... E04B 2/76 52/235

(Continued)

*Primary Examiner* — James M Ference
(74) *Attorney, Agent, or Firm* — Miller, Matthias & Hull LLP

(57) ABSTRACT

An expansion joint configured to connect first and second vertical mullions of a curtain wall is disclosed. The first and second vertical mullions may each include an elongated body having an inner contour defining a hollow slot, and an inner sleeve may extend through the hollow slot of both of the first and second vertical mullions. The expansion joint may comprise a body, and an inner contour defining a central inner slot configured to receive the inner sleeve therethrough. The expansion joint may further comprise a first raised lip projecting from a lower surface of the body and configured to be inserted inside of the inner contour of the first vertical mullion, and a second raised lip projecting from an upper surface of the body and configured to be inserted inside of the inner contour of the second vertical mullion. The expansion joint may be formed from a polymeric elastomer.

20 Claims, 10 Drawing Sheets

(56) References Cited

U.S. PATENT DOCUMENTS 4,873,806 A * 10/1989 Jeschke ..... E04B 2/962 52/235
5,067,293 A * 11/1991 Reynolds ..... E04B 2/88 52/235
5,481,839 A * 1/1996 Lang ..... E04B 2/967 52/235
5,592,795 A * 1/1997 Rinehart ..... E04B 2/967 52/204.591
5,603,789 A * 2/1997 Whitmyer ..... E04B 2/96 156/108
5,794,382 A * 8/1998 Prucinsky ..... E06B 1/524 49/365
6,141,923 A * 11/2000 Habicht ..... E04B 1/943 52/232
6,745,527 B1 * 6/2004 Sherman ..... E04B 2/96 52/235
6,748,709 B1 * 6/2004 Sherman ..... E04B 2/96 52/235
9,752,319 B1 * 9/2017 Levan ..... E04B 2/965
9,797,131 B1 * 10/2017 Battaglia ..... E04B 1/84
10,400,445 B2 * 9/2019 Battaglia ..... E04B 1/8209
2002/0124499 A1 * 9/2002 Braybrook ..... E04B 2/96 52/235
2003/0033764 A1 * 2/2003 Ting ..... E04B 2/96 52/235
2004/0079038 A1 * 4/2004 Crooker, Jr. ..... E04B 2/96 52/235
2005/0284053 A1 * 12/2005 Grunewald ..... E04B 2/96 52/235
2006/0016133 A1 * 1/2006 Speck ..... E04B 2/90 52/79.1
2006/0080917 A1 * 4/2006 Hall ..... E04B 2/965 52/235
2006/0201084 A1 * 9/2006 Arias ..... E04B 2/965 52/235
2008/0313982 A1 * 12/2008 Termohlen ..... E04B 2/90 52/235
2009/0241466 A1 * 10/2009 Gussakovsky ..... E04B 2/88 52/786.1
2010/0293882 A1 * 11/2010 Labrecque ..... E04B 2/967 52/705
2011/0138727 A1 * 6/2011 Labrecque ..... E04B 2/965 52/483.1
2011/0298185 A1 * 12/2011 Dolby ..... E06B 3/5427 277/630
2014/0345215 A1 * 11/2014 Magoon ..... E06B 3/5427 52/235
2015/0135615 A1 * 5/2015 Hogan ..... E04B 2/90 52/235
2015/0284951 A1 * 10/2015 Frederick ..... E04B 2/965 52/235
2016/0053487 A1 * 2/2016 Frederick ..... E04B 2/90 52/235
2016/0069073 A1 * 3/2016 Grise ..... E04B 2/967 52/235
2016/0222653 A1 * 8/2016 Niehaus ..... E04B 2/967
2017/0058538 A1 * 3/2017 Zahner ..... E04F 19/02
2017/0298621 A1 * 10/2017 Frederick ..... E04B 2/967

* cited by examiner

CURTAIN WALL EXPANSION JOINT

TECHNICAL FIELD

The present disclosure generally relates to curtain walls for buildings and, more specifically, to curtain walls having expansion joints configured to permit deflection of the floor structures of buildings.

BACKGROUND

A curtain wall is an outer covering of a building that spans multiple floors. A curtain wall is non-load bearing in that it does not carry the structural load of the building, other than its own dead weight. As curtain walls are non-load bearing, they may be fabricated from lightweight materials to reduce construction costs. Curtain walls may be designed to keep weather out by resisting air and water infiltration into the building. Furthermore, curtain walls may be designed to accommodate thermal expansion and contraction, and to absorb building sway induced by wind and/or seismic forces. Loads that are imposed on a curtain wall may be transferred to the building through floor anchors that connect the curtain wall to the floor structures of the building.

A curtain wall may be composed of a frame formed from a plurality of horizontal and vertical members. The horizontal and vertical members of the frame may connect to form frame units that receive infill panels of an infill material such as glass, metal, or stone veneer. The vertical members of the frame may be formed from vertical mullions, and the horizontal members of the frame may be formed from transoms or horizontal mullions. The vertical mullions and the horizontal mullions may be formed from a lightweight material, such as extruded aluminum. The vertical and horizontal mullions may assemble with gaskets and pressure plates to create a glazing pocket configured to capture and form a seal with the infill panels. Curtain walls may be characterized as "mullion drained" in which water drainage and ventilation may occur in grooves along the face of the vertical mullions. By contrast, in "zone drained" curtain walls, each infill panel may drain individually so water cannot drain along the lengths of the mullion. In addition, curtain walls may be characterized as "stick" or "unitized" systems. In stick systems, assembly of the frame and glazing (installation of the infill panels) may performed on-site, whereas in unitized systems, frame assembly and glazing is performed at a factory and the fully assembled curtain wall is subsequently erected on the building.

Although current curtain walls are effective, changing practices in building construction are leading to floor structures with deflection limits that are higher than what existing curtain walls may be able to accommodate. For instance, one existing curtain wall design only permits ±2 millimeters of movement, well below the deflection limits of the floor structures of some modern buildings. Other curtain wall systems allow for more movement of the floor structures, but are not widely implemented in practice due to their high costs.

Thus, there is a need for cost-effective curtain wall systems that accommodate the higher deflection limits of the floor structures in some building designs.

SUMMARY

A first embodiment of an expansion joint configured to connect first and second vertical mullions of a curtain wall is disclosed. The first and second vertical mullions may each include an elongated body having an inner contour defining a hollow slot and an infill support tongue extending from a side of the elongated body. The first and second vertical mullions may include an inner sleeve extending through the hollow slot of both the first and second vertical mullions. The expansion joint may comprise a body having sides, an upper surface, and a lower surface. The expansion joint may further comprise an inner contour defining a central inner slot extending through the body from the upper surface to the lower surface, and the central inner slot may be configured to receive the inner sleeve therethrough. The expansion joint may further comprise a first raised lip projecting from the lower surface of the body, and a second raised lip projecting from the upper surface of the body. The first raised lip may be configured to insert inside of the inner contour of the first vertical mullion, and the second raised lip may be configured to insert inside of the inner contour of the second vertical mullion.

In a further embodiment of the expansion joint, the expansion joint may be formed from a polymeric elastomer foam.

In another further embodiment of the expansion joint, the expansion joint may additionally and/or alternatively be formed from a closed cell ethylene propylene diene monomer (EPDM) foam rubber sponge.

In another further embodiment of the expansion joint, the first raised lip and the second raised lip may each circumscribe the central inner slot.

In another further embodiment of the expansion joint, the inner contour defining the central inner slot may have a shape corresponding to an outer contour of the inner sleeve.

In another further embodiment of the expansion joint, the first raised lip may be additionally and/or alternatively configured to form an interference fit with the inner contour of the first vertical mullion, and the second raised lip may be additionally and/or alternatively configured to form an interference fit with the inner contour of the second vertical mullion.

In another further embodiment of the expansion joint, the expansion joint may additionally and/or alternatively comprise a projection extending from one of the sides of the body, and the projection may be configured to be inserted between the infill support tongues of the first and second vertical mullions when the expansion joint is assembled with the first and second vertical mullions.

In another further embodiment of the expansion joint, the expansion joint may additionally and/or alternatively include a tab on either side of the projection, and the tabs may extend from the side of the body that includes the projection.

In another further embodiment of the expansion joint, the expansion joint may additionally and/or alternatively include a support rod extending through at least one of the projection and the tabs.

A first embodiment of a curtain wall for a building having floor structures is disclosed. The curtain wall may comprise a frame anchored to the floor structures, and the frame may include a plurality of frame units composed of horizontal and vertical members. The curtain wall may further comprise infill panels supported by the frame units, and vertical mullions forming the vertical members. Each of the vertical mullions may include an elongated body having an inner contour defining a hollow slot, an infill support tongue extending from a side of the elongated body and assembled with a thermal break, and a gasket along the side of the elongated body. The curtain wall may further comprise an inner sleeve inserted through the hollow slots of an adjacent pair of the vertical mullions, and an expansion joint connecting the adjacent pair of the vertical mullions. The expansion joint may include a body having sides, an upper surface, and a lower surface. The expansion joint may further include an inner contour defining a central inner slot receiving the inner sleeve therethrough, a first raised lip projecting from the lower surface of the body and inserted inside of the inner contour of a first vertical mullion of the adjacent pair of the vertical mullions, and a second raised lip projecting from the upper surface of the body and inserted inside of the inner contour of a second vertical mullion of the adjacent pair of the vertical mullions. The expansion joint may be formed from a compressible elastomeric material that allows the adjacent pair of the vertical mullions to accommodate deflection of the floor structures.

In a further embodiment of the curtain wall, the expansion joint may be formed from a closed cell ethylene propylene diene monomer (EPDM) foam rubber sponge.

In another further embodiment of the curtain wall, the expansion joint may be configured to allow the adjacent pair of vertical mullions to accommodate about ±15 millimeters of deflection of the floor structures.

In another further embodiment of the curtain wall, the curtain wall may additionally and/or alternatively include pressure plates assembled with the first and second vertical mullions, and a pressure plate expansion unit between the pressure plates. The pressure plate expansion unit may be formed from a compressible material that allows the adjacent pair of vertical mullions to accommodate the deflection of the floor structures.

In another further embodiment of the curtain wall, the expansion joint and the pressure plate expansion unit may be formed from a closed cell ethylene propylene diene monomer (EPDM) foam rubber sponge.

In another further embodiment of the curtain wall, the expansion joint and the pressure plate expansion unit may be configured to allow the adjacent pair of the vertical mullions to accommodate about ±15 millimeters of movement.

In another further embodiment of the curtain wall, the first and second vertical mullions may each additionally and/or alternatively include an outer sleeve received in the hollow slot of the vertical mullion between the inner contour of the vertical mullion and the inner sleeve. The first raised lip of the expansion joint may be inserted between the inner contour of the first vertical mullion and the outer sleeve of the first vertical mullion. The second raised lip of the expansion joint may be inserted between the inner contour of the second vertical mullion and the outer sleeve of the second vertical mullion.

In a further embodiment of the curtain wall, the expansion joint may additionally and/or alternatively include a projection extending from one of the sides of the body, and a tab on either side of the projection. The tabs may be inserted between the gaskets of the first and second vertical mullions.

In a further embodiment of the curtain wall, the expansion joint may additionally and/or alternatively include a support rod extending through at least one of the projection and the tabs.

In a further embodiment of the curtain wall, the expansion joint may be positioned at a level of one of the floor structures.

A first embodiment of a method of assembling vertical mullions of a curtain wall using an expansion joint is disclosed. The expansion joint may include a body, a central inner slot extending through the body, a first raised lip projecting from a lower surface of the body, and a second raised lip projecting from an upper surface of the body. The method may comprise inserting a first end of an inner sleeve into an inner slot of a first outer sleeve, inserting a second end of the inner sleeve through the central inner slot of the expansion joint, sliding a first vertical mullion over the first outer sleeve, and fitting the first raised lip of the expansion joint into an inner contour of the first vertical mullion. The method may further comprise inserting the second end of the inner sleeve into an inner slot of a second outer sleeve, sliding a second vertical mullion over the second outer sleeve, and fitting the second raised lip of the expansion joint into an inner contour of the second vertical mullion.

These and other aspects and features of the present disclosure will be more readily understood when read in conjunction with the accompanying drawings.

DETAILED DESCRIPTION

Figure 1:
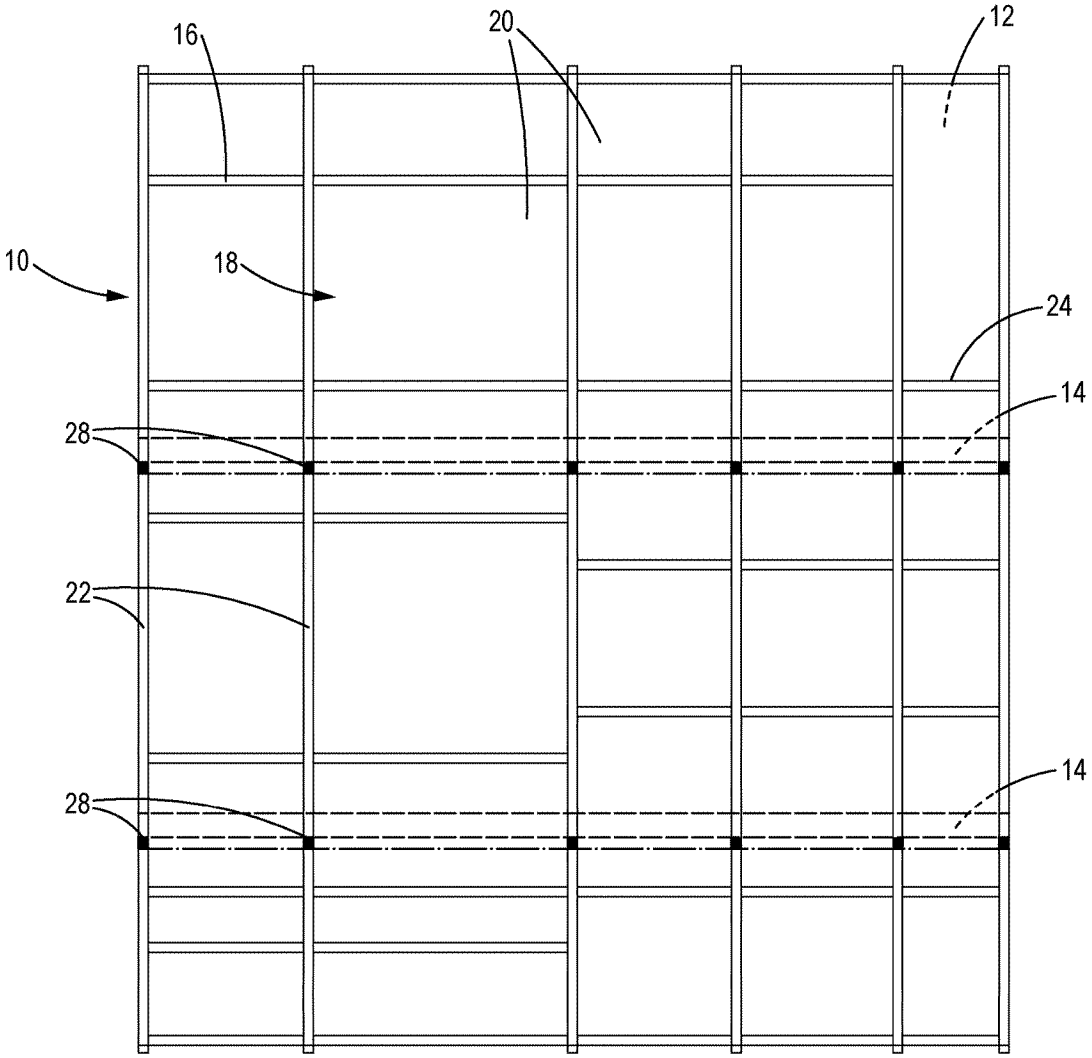
FIG. 1 is a front view of a curtain wall connected to a building, constructed in accordance with the present disclosure.

Referring now to the drawings, and with specific reference to FIG. 1, a curtain wall 10 attached to a building 12 is shown. The curtain wall 10 may provide an outer covering for the building 12 and may be anchored to floor structures 14 of the building 12. As is understood by those with ordinary skill in the art, the curtain wall 10 may provide a weather barrier that resists air and/or water infiltration into the building 12, while also absorbing building sway caused by various forces acting on the building 12. In contrast to other curtain walls of the prior art, the curtain wall 10 disclosed herein may accommodate substantial movement or deflection of the floor structures 14 without distorting or losing its structural integrity. In some embodiments, the curtain wall 10 may be configured to accommodate about ±15 millimeters or more of movement of the floor structures 14. In other embodiments, the curtain wall 10 may be configured to accommodate about ±10 millimeters or more of movement of the floor structures 14. In other embodiments, the curtain wall 10 may be configured to accommodate about ±5 millimeters or more of movement of the floor structures 14.

The curtain wall 10 may include a frame 16 anchored to the floor structures 14, and the frame 16 may be composed of a plurality of frame units 18 that support infill panels 20. The infill panels 20 may be panels of an infill material such as, but not limited to, glass, metal, or stone veneer. The frame 16 may be composed of a plurality of vertical members 22 and horizontal members 24 that interconnect to form the frame units 18. The vertical members 22 may include vertical mullions 26 (see FIG. 2), and the horizontal members 24 may include horizontal mullions. The vertical mullions 26 and the horizontal mullions may be formed from a lightweight material such as, but not limited to, extruded aluminum.

The vertical mullions 26 disclosed herein may be split (or divided into separate pieces) at each of the floor structures 14. Connecting the split vertical mullions 26 at each of the floor structures 14 may be an expansion joint 28 (also see FIG. 2). More specifically, each of the expansion joints 28 may be located at the level of one of the floor structures 14 and may connect an adjacent pair of the vertical mullions 26 (also see FIG. 2). As explained in further detail below, the expansion joints 28 may provide the vertical mullions 26 with freedom to move in response to movement or deflection of the floor structures 14 while maintaining a seal with the infill panels 20.

Figure 3:
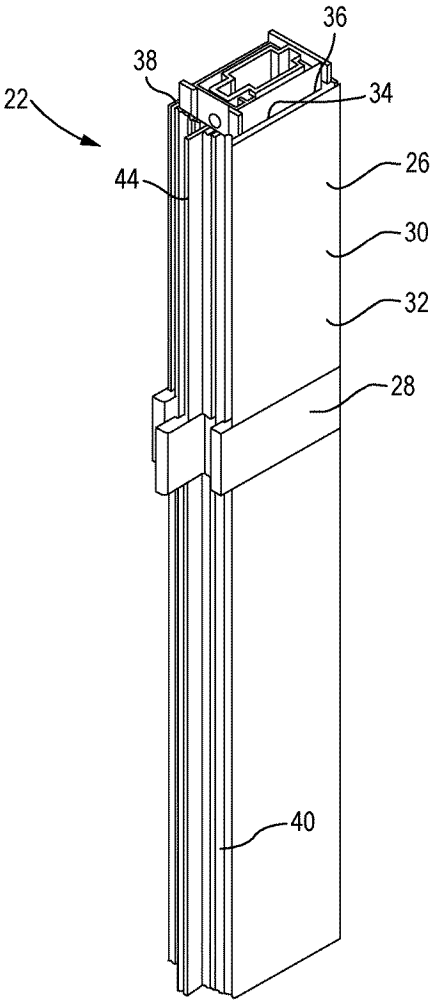
FIG. 3 is a perspective view of vertical mullions and an expansion joint of the vertical member of FIG. 2, constructed in accordance with the present disclosure.
Figure 2:
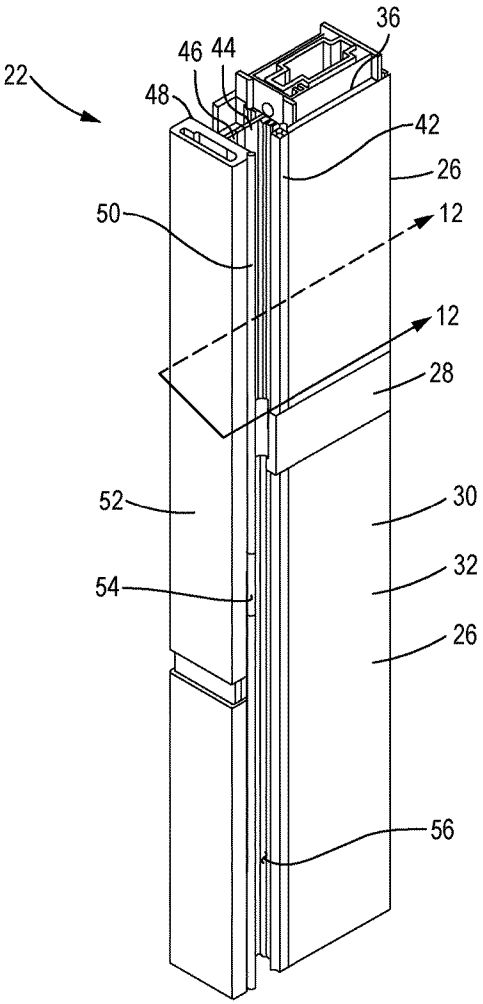
FIG. 2 is a perspective view of a portion of a vertical member of the curtain wall, constructed in accordance with the present disclosure.

Turning now to FIGS. 2-3, a portion of a vertical member 22 of the curtain wall 10 is shown. The portion of the vertical member 22 shown in FIGS. 2-3 includes the expansion joint 28 that connects an adjacent pair of the vertical mullions 26 at the level of one of the floor structures 14. The vertical mullions 26 may each include an outer wall 30 having an elongated body 32 with an inner contour 34 that forms a hollow slot 36 (also see FIG. 10). Extending lengthwise along a side 38 of the elongated body 32 may be one or more grooves 40 (FIG. 3) that receive gaskets 42 (FIG. 2). Protruding from the side 38 of the elongated body 32 having the grooves 40 may also be an infill support tongue 44 (FIG. 3) which assembles with a thermal break 46 (FIG. 2). Pressure plates 48 having gaskets 50 may be assembled along the thermal break 46, and outer capping plates 52 may cover the pressure plates 48 (FIG. 2). The pressure plates 48 may be formed from extruded aluminum, and the thermal break 46 may be formed from a low conductivity material that thermally insulates the extruded aluminum mullions from the pressure plates 48. Additionally, the pressure plates 48 may be separated by a pressure plate expansion unit 54 which further serves to accommodate deflection/movement of the floor structures 14 (see further details below). In the fully assembled frame unit 18, the pressure plate expansion unit 54 may form a seal with the infill panel 20 and the pressure plates 48.

The vertical member 22 may form a portion of a glazing pocket 56 that receives and forms a seal with one of the infill panels 20. Namely, the glazing pocket 56 of the vertical member 22 may include the gaskets 42, the infill support tongue 44, the thermal break 46, the gaskets 50 of the pressure plates 48, the pressure plates 48, and the pressure plate expansion unit 54.

Figure 5:
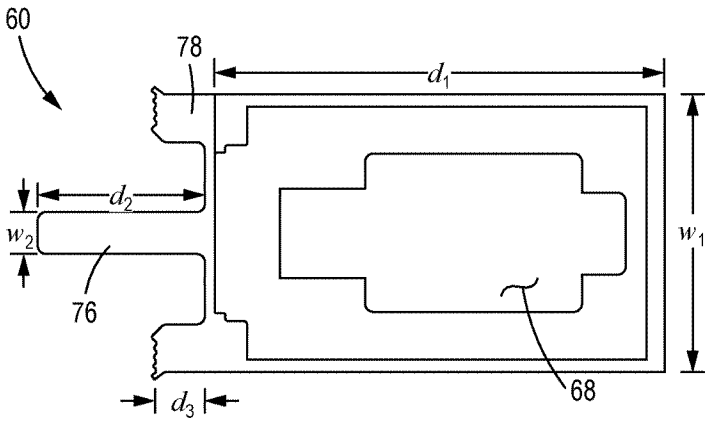
FIG. 5 is a top view of the expansion joint of FIG. 4, constructed in accordance with the present disclosure.
Figure 6:
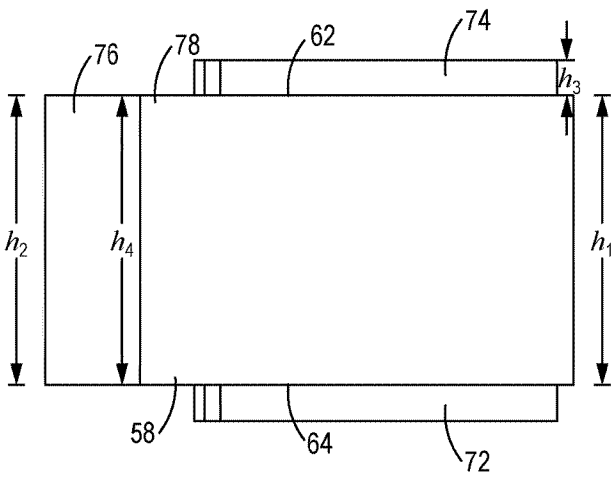
FIG. 6 is a side view of the expansion joint of FIG. 4, constructed in accordance with the present disclosure.
Figure 4:
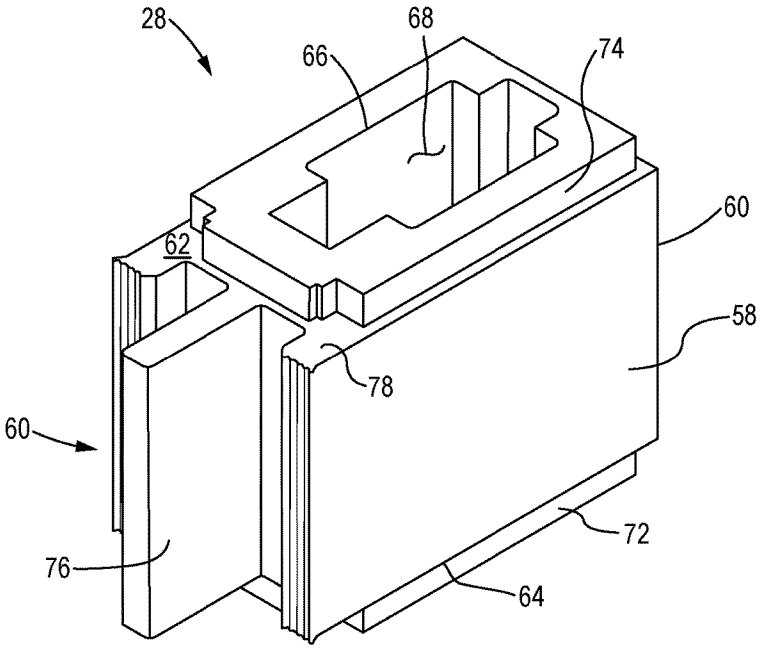
FIG. 4 is a perspective view of the expansion joint shown in isolation, constructed in accordance with the present disclosure.

The expansion joint 28 is shown in isolation in FIGS. 4-6. The expansion joint 28 may be formed from an elastomeric material that compresses to accommodate shifting or movement of the vertical mullions 26. For instance, the compressible elastomeric material may be a polymeric elastomer foam. As a non-limiting example, the expansion joint 28 may be formed from ethylene propylene diene monomer (EPDM) rubber, such as a closed cell (non-porous) EPDM foam rubber sponge. However, other suitable types of compressible elastomeric materials may also be used.

The expansion joint 28 may have a body 58 that includes sides 60, an upper surface 62, and a lower surface 64. The shape of the body 58 may correspond to the outer shape of the vertical mullions 26. For instance, the body 58 may have a rectangular shape as shown, although it may have other shapes as well in alternative arrangements. An inner contour 66 of the expansion joint 28 may define a central inner slot 68 that extends through the body 58 from the upper surface 62 to the lower surface 64. The central inner slot 68 may be configured to receive an inner sleeve 70 therethrough when the expansion joint 28 is assembled with the vertical mullions 26 (see FIGS. 9-10 and further details below). A first raised lip 72 may project from the lower surface 64 of the body 58 and a second raised lip 74 may project from the upper surface 62 of the body 58, with the first and second raised lips 72 and 74 both circumscribing the central inner slot 68. As explained in further detail below with reference to FIGS. 11-12, the first and second raised lips 72 and 74 may be configured to be inserted inside of the inner contour 34 of the vertical mullions 26.

The expansion joint 28 may also include a projection 76 extending from one of the sides 60 of the body 58 and along a height ($h_1$) of the expansion joint 28 from the upper surface 62 to the lower surface 64 (see FIG. 6). In one arrangement, a height ($h_2$) of the projection 76 may be equivalent to the height ($h_1$) of the body 58 (see FIG. 6). The projection 76 may be configured to be inserted between the infill support tongues 44 and the thermal breaks 46 of the adjacent pair of vertical mullions 26 (see FIGS. 2-3). Tabs 78 may also flank the projection 76 along the side 60 of the body 58 that includes the projection 76, and the tabs 78 may be configured to be inserted between the gaskets 42 of the adjacent pair vertical mullions 26 (see FIG. 2). The tabs 78 may have a height ($h_2$) that is equivalent to the height ($h_1$) of the body 58 (see FIG. 6).

The height ($h_1$) of the expansion joint 28, as measured from the upper surface 62 to the lower surface 64, may be selected so that the expansion joint 28 is compressible enough to accommodate the deflection limits of the floor structures 14. As a non-limiting example, if the expansion joint 28 is formed from a closed cell EPDM foam rubber sponge, it may have a height of about 80 millimeters to accommodate about 1-15 millimeters of movement of the floor structures 14. In such an arrangement, the first and second raised lips 72 and 74 may have a height ($h_3$) of about 10 millimeters, and the body 58 may have a width ($w_1$) of about 65 millimeters. It will be understood, however, the expansion joint 28 may have other heights depending on such factors as the material that it is fabricated from, the building floor structure deflection limits, and/or the dimensions of the other components of the vertical member 22.

Other dimensions of the expansion joint 28 may be variable to suit the dimensions of the components of the vertical member 22. For example, a depth ($d_1$) of the expansion joint 28 may be selected to compliment or match the depth of the vertical mullions 26 (see FIG. 5). Likewise, a depth ($d_2$) and width ($w_2$) of the projection 76 may be selected to compliment or match the corresponding depths and widths of the thermal break 46 and the infill support tongue 44. Additionally, a depth ($d_3$) of the tabs 78 may be selected to compliment or match the depth of the gaskets 42.

Figure 8:
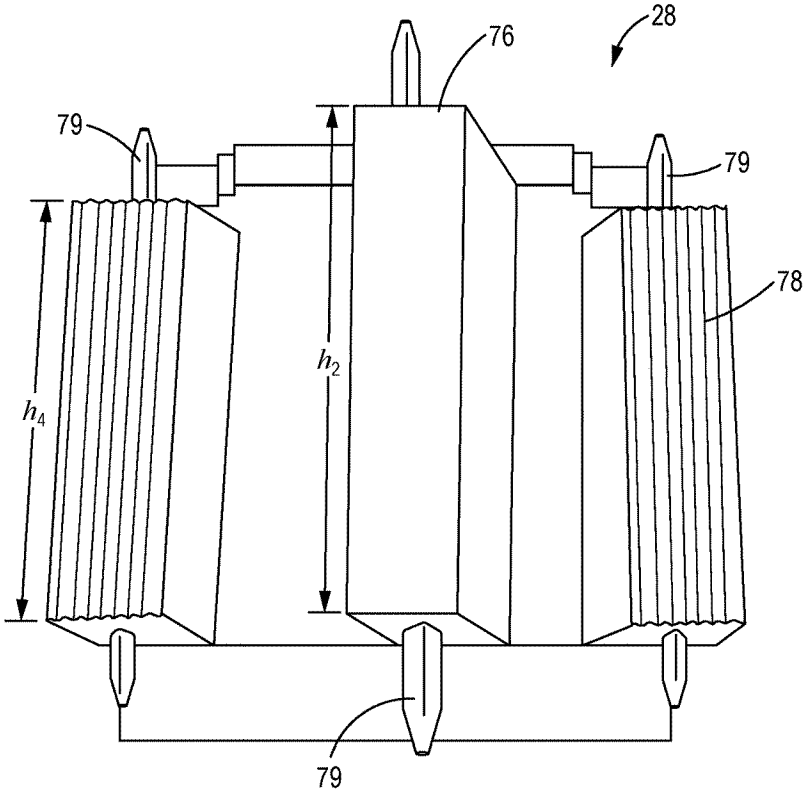
FIG. 8 is a side view of the expansion joint of FIG. 7, constructed in accordance with the present disclosure.
Figure 7:
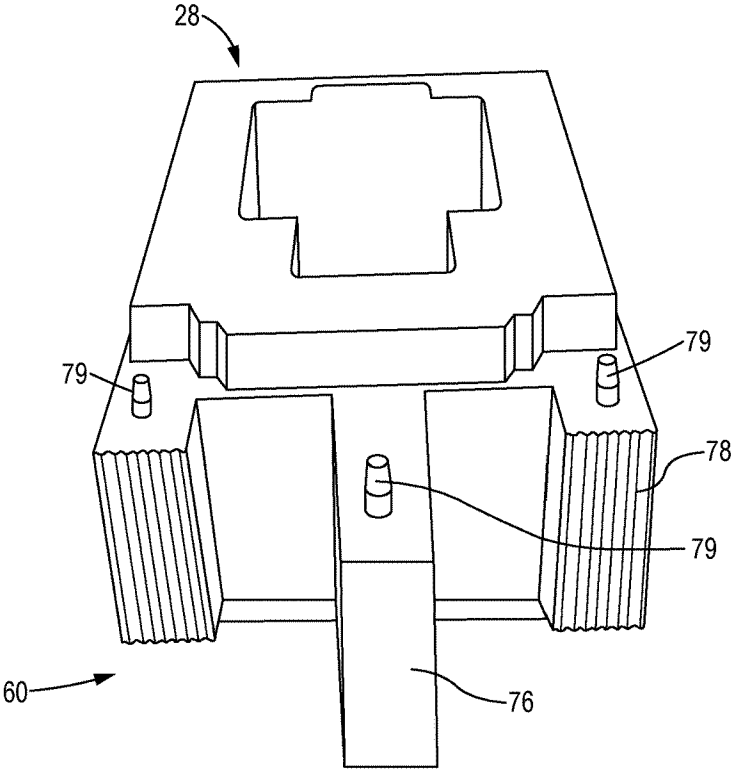
FIG. 7 is a perspective view of the expansion joint similar to FIG. 4 but having support rods, constructed in accordance with the present disclosure.

In an alternative arrangement shown in FIGS. 7-8, the expansion joint 28 may further include one or more support rods 79 to stabilize and prevent distortion of the expansion joint 28 when it is under compression. For example, one or more support rods 79 may be included in the projection 76 and/or the tabs 78. In one arrangement, the projection 76 and the tabs 78 may each include a support rod 79 extending therethrough along their heights $h_2$ and $h_4$, respectively. Other arrangements may have a single support rod 79 in just the projection 76 or one of the tabs 78, or multiple support rods 79 in the projection 76 and/or the tabs 78. The support rods 79 may also serve to assist in locating the expansion joint 28 in the vertical member assembly, and to seal the projection 76 and the tabs 78 in the assembly.

Figure 10:
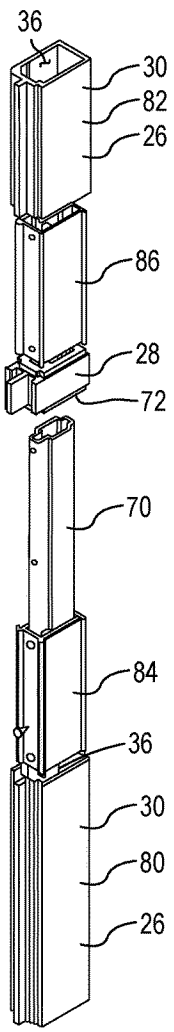
FIG. 10 is an exploded view of the vertical mullions and the expansion joint of FIG. 3, constructed in accordance with the present disclosure.
Figure 9:
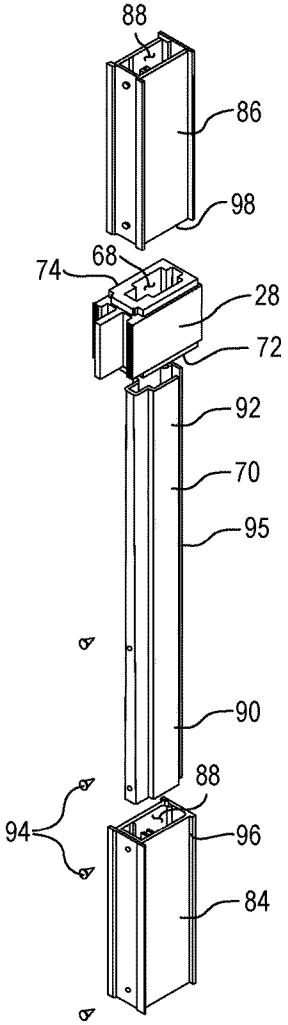
FIG. 9 is an exploded view of an assembly of the expansion joint with an inner sleeve and outer sleeves of the vertical mullions, constructed in accordance with the present disclosure.

Turning now to FIGS. 9-10, an exploded view of the assembly of the expansion joint 28 with the adjacent pair of vertical mullions 26 is shown. The adjacent pair of vertical mullions 26 may include a first vertical mullion 80 and a second vertical mullion 82 (see FIG. 10). A first outer sleeve 84 may be inserted inside of the hollow slot 36 of the outer wall 30 of the first vertical mullion 80, and a second outer sleeve 86 may be inserted inside of the hollow slot 36 of the outer wall 30 of the second vertical mullion 82. Each of the first and second outer sleeves 84 and 86 may have an inner slot 88 that receives the inner sleeve 70 (see FIG. 9), and the inner sleeve 70 may be inserted through the central inner slot 68 of the expansion joint 28. When assembled, the inner sleeve 70 may extend lengthwise along both of the first and second vertical mullions 80 and 82. That is, the inner sleeve 70 may be a single piece having a first end 90 received in the first vertical mullion 80 and a second end 92 received in the second vertical mullion 82. The inner sleeve 70 and the outer sleeves 84 and 86 may be formed from the same material as the outer walls 30 of the vertical mullions 26, such as extruded aluminum.

A method of assembling the expansion joint 28 with the first and second vertical mullions 80 and 82 will now be described. Referring first to FIG. 9, the first end 90 of the inner sleeve 70 may be inserted in the inner slot 88 of the first outer sleeve 84, and the first outer sleeve 84 may be fastened to the first end 90 of the inner sleeve 70 using one or more fasteners 94. The second end 92 of the inner sleeve 70 may then be inserted inside of the central inner slot 68 of the expansion joint 28, with the expansion joint 28 being slid over an outer contour 95 of the inner sleeve 70 until the first raised lip 72 of the expansion joint 28 rests on or is near an upper surface 96 of the first outer sleeve 84. To facilitate the insertion of the inner sleeve 70, the central inner slot 68 may have a shape that corresponds to the outer contour 95 of the inner sleeve 70, as shown.

Turning to FIG. 10, the first vertical mullion 80 may then be slid over the first outer sleeve 84, and the first raised lip 72 of the expansion joint 28 may be inserted into the inner contour 34 of the first vertical mullion 80 to form an interference fit that locks the first vertical mullion 80 in position. Referring back to FIG. 9, the second end 92 of the inner sleeve 70 may then be inserted inside of the inner slot 88 of the second outer sleeve 86 until the second raised lip 74 of the expansion joint 28 contacts or is near a lower surface 98 of the second outer sleeve 86. The second end 92 of the inner sleeve 70 may then be fastened to the second outer sleeve 86 using one or more fasteners 94. The second vertical mullion 82 may then be slid over the second outer sleeve 86, and the second raised lip 74 of the expansion joint 28 may be fit into the inner contour 34 of the second vertical mullion 82 to form an interference fit that locks the second vertical mullion 82 in position (FIG. 10).

Figure 12:
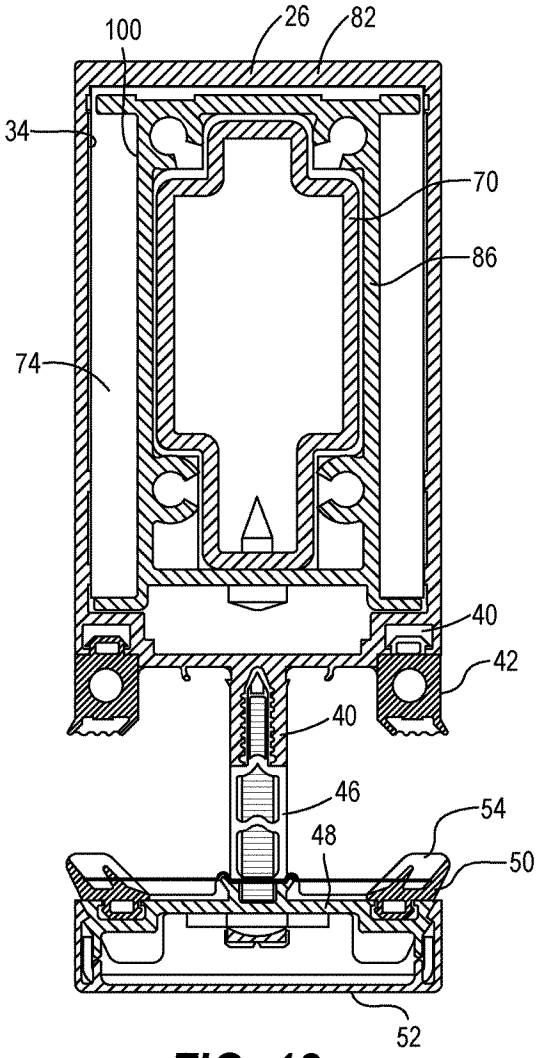
FIG. 12 is a cross-sectional view through the section 12-12 of FIG. 2, illustrating the assembly of the expansion joint with the vertical mullions, constructed in accordance with the present disclosure.
Figure 11:
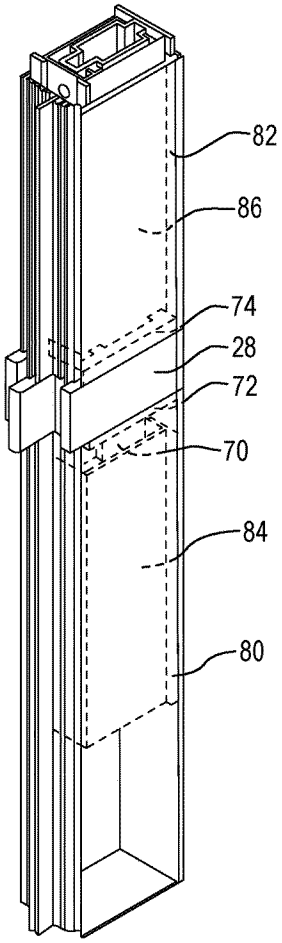
FIG. 11 is a perspective view of the vertical mullions of FIG. 3 with the outer walls of the vertical mullions being transparent to illustrate an assembly of the expansion joint with the vertical mullions, constructed in accordance with the present disclosure.

The assembly of the expansion joint 28 with the first and second vertical mullions 80 and 82 is shown in greater detail in FIGS. 11-12. As explained above, the first and second raised lips 72 and 74 of the expansion joint 28 may be inserted inside of the inner contours 34 of the first and second vertical mullions 80 and 82, respectively. In the assembled structure, the first and second raised lips 72 and 74 of the expansion joint 28 may be positioned between the inner contour 34 of the respective vertical mullion (80 or 82) and an outer contour 100 of the respective outer sleeve (84 or 86) (see FIG. 12). The cross-sectional view of FIG. 12 shows the insertion of the second raised lip 74 between the inner contour 34 of the second vertical mullion 82 and the outer contour 100 of the second outer sleeve 86.

Figure 13:
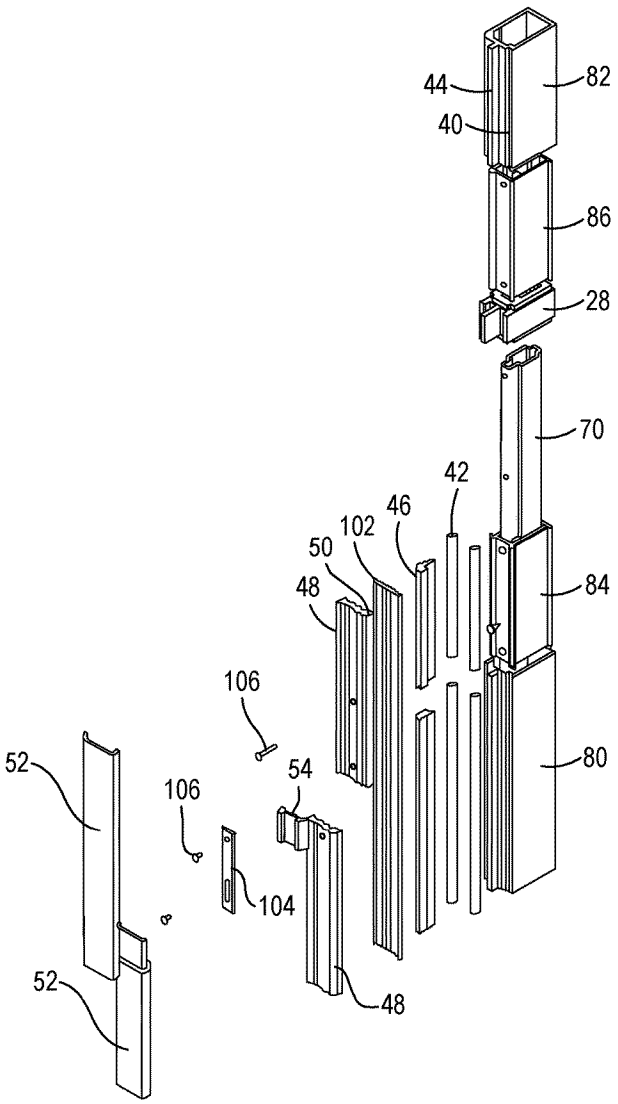
FIG. 13 is an exploded view of the vertical member of FIG. 2, constructed in accordance with the present disclosure.

FIG. 13 shows an exploded view of the components of the vertical member 22 of FIG. 2. The assembly of the first and second vertical mullions 80 and 82 using the expansion joint 28 may be carried out as explained above with reference to FIGS. 9-10. The gaskets 42 may be connected to the grooves 40 along the first and second vertical mullions 80 and 82, and the thermal breaks 46 may be connected to the infill support tongues 44 of the first and second vertical mullions 80 and 82. The pressure plates 48 may be attached to the first and second vertical mullions 80 and 82 using fasteners 106, and a tape 102 (such as a butyl tape) may be applied to provide additional weather sealing protection to the infill panels 20 once installed. The pressure plate expansion unit 54 may also be connected to the pressure plates 48 using a joint strap 104 and fasteners 106. The joint strap 104 may also hold the pressure plate expansion unit 54 in contact with the infill panel 20 in the assembled frame unit 18. The outer capping plates 52 may be installed to cover the pressure plates 48 and the pressure plate expansion unit 54. In the fully assembled frame unit 18, the outer capping plates 52 may assist in sealing the pressure plates 48 and the pressure plate expansion unit 54 against the infill panel 20.

As the pressure plates 48 are fixed to the vertical mullions 26 (see FIG. 2), the pressure plates 48 may move with the vertical mullions 26 in response to the deflection of the floor structures 14 or other building movements. The pressure plate expansion unit 54 may assist the expansion joint 28 in providing the vertical mullions 26 with enough freedom of motion to accommodate such movement while maintaining a seal with the infill panels 20.

Figure 15:
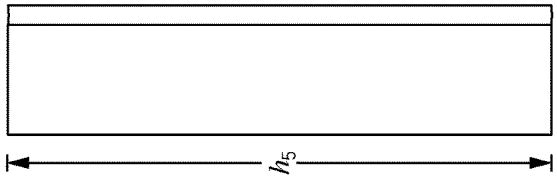
FIG. 15 is a side view of the pressure plate expansion unit of FIG. 14, constructed in accordance with the present disclosure.
Figure 16:
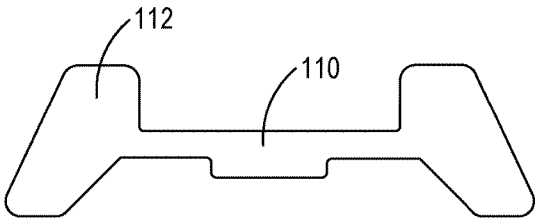
FIG. 16 is a top view of the pressure plate expansion unit of FIG. 14, constructed in accordance with the present disclosure.
Figure 14:
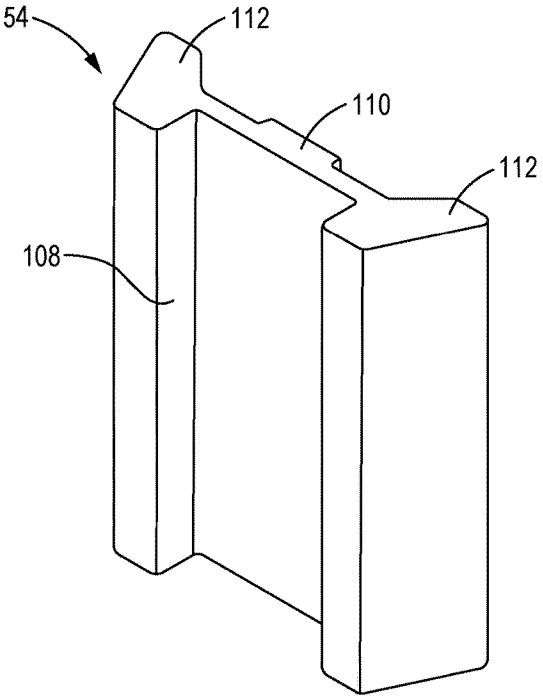
FIG. 14 is a perspective view of a pressure plate expansion unit, constructed in accordance with the present disclosure.

The pressure plate expansion unit 54 is shown in isolation in FIGS. 14-16. As the pressure plate expansion unit 54 may compress in response to floor structure movement or other forces acting on the curtain wall 10, it may be formed from a compressible elastomeric material such as a polymeric elastomer foam. As a non-limiting example, the pressure plate expansion unit 54 may be formed from ethylene propylene diene monomer (EPDM) rubber, such as a closed cell (non-porous) EPDM foam rubber sponge. In one arrangement, the expansion joint 28 and the pressure plate expansion unit 54 are both formed from the same material, such as a closed cell EPDM foam rubber sponge.

The pressure plate expansion unit 54 may have an outer contour 108 that at least generally corresponds to or matches the outer contour of the pressure plates 48 and the gaskets 50. For instance, the pressure plate expansion unit 54 may have a narrow central region 110 flanked by thicker regions 112 that compliment or match the shape of the pressure plates 48 when assembled with the gaskets 50. The dimensions of the pressure plate expansion unit 54 may vary depending on a number of considerations such as its material construction, the dimensions of the pressure plates 48 and the gaskets 50, and/or the floor structure deflection limits. The pressure plate expansion unit 54 may have a height ($h_5$) (see FIG. 15) that is equivalent to the height ($h_1$) of the expansion joint 28 (see FIG. 6). For instance, the pressure plate expansion unit 54 and the expansion joint 28 may both have a height of about 80 millimeters. In some embodiments, the pressure plate expansion unit 54 and the expansion joint 28 may both be formed from the same compressible polymeric elastomer material. For example, in one arrangement, the pressure plate expansion unit 54 and the expansion joint 28 may both be formed from a closed cell EPDM foam rubber sponge.

Although the expansion joint 28 and the pressure plate expansion unit 54 of the present disclosure are shown applied to a zone drained curtain wall for consistency and simplicity, the expansion pieces may also be applied to mullion drained curtain walls as those with ordinary skill in the art will appreciate. In addition, it will be understood that the expansion joint 28 and the pressure plate expansion unit 54 may be applied to stick type curtain walls, unitized curtain walls, or other types of curtain walls. Furthermore, the expansion joint 28 and the pressure plate expansion unit 54 may assist in accommodating any type of force or movement/deflection that the vertical members 22 of the curtain wall experience, not only floor structure movement. The scope of the present disclosure encompasses variations such as these.

INDUSTRIAL APPLICABILITY

In general, the teachings of the present disclosure may find applicability in many industries including building construction industries. More specifically, the teachings of the present disclosure may be applicable to industries providing curtain walls in which the vertical members of the curtain wall are required to have a freedom of motion sufficient to accommodate building floor structure movement or other forces acting on the curtain wall.

Figure 17:
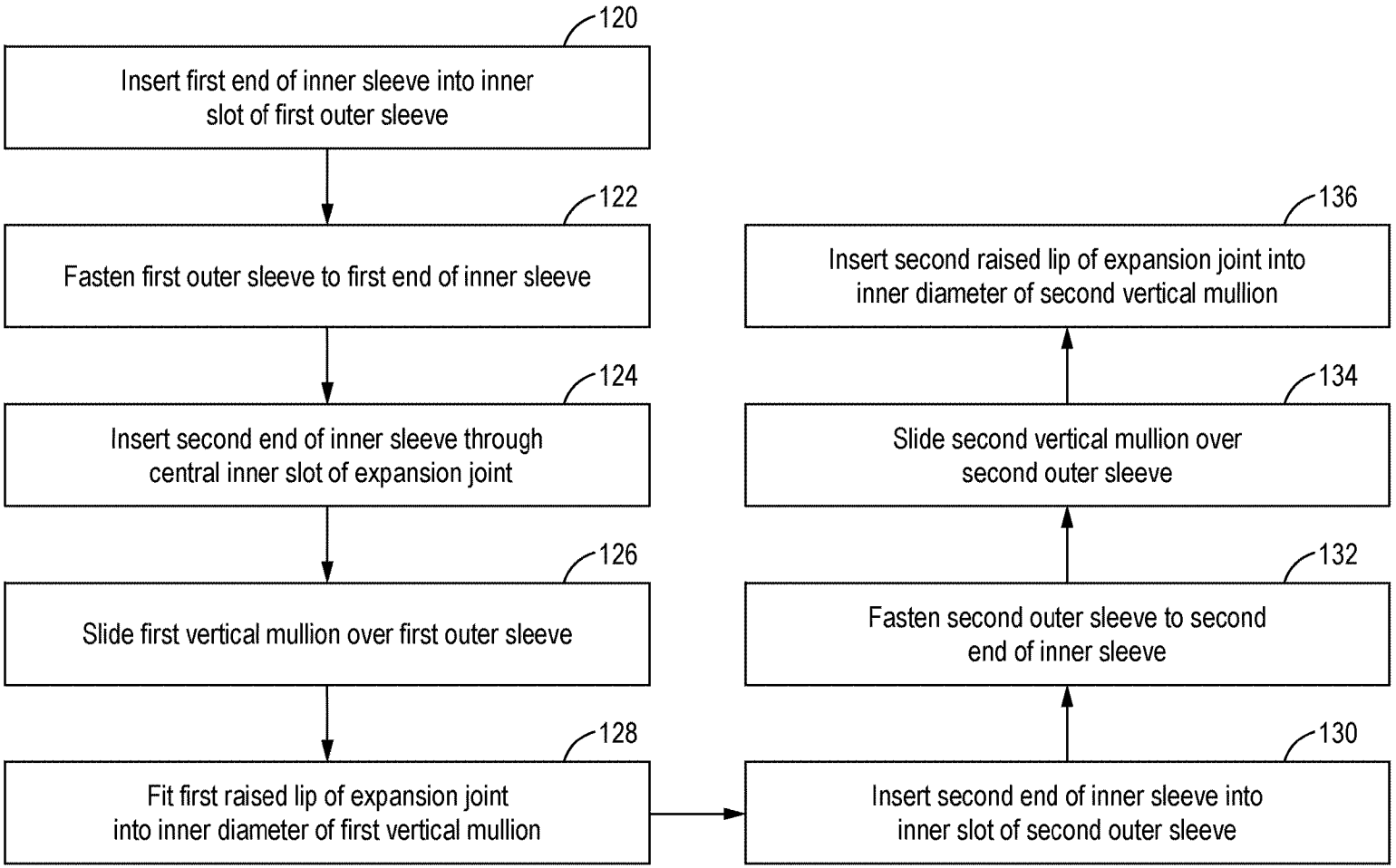
FIG. 17 is a flowchart of a series of steps that may be involved in assembling the vertical mullions using the expansion joint, in accordance with a method of the present disclosure.

FIG. 17 shows a series of steps that may be involved in assembling the first and second vertical mullions 80 and 82 using the expansion joint 28. Beginning at a first block 120, the first end 90 of the inner sleeve 70 may be inserted into the inner slot 88 of the first outer sleeve 84 of the first vertical mullion 80 (see FIGS. 9 and 10). The first outer sleeve 84 may then be fastened to the first end 90 of the inner sleeve 70 according to a block 122 (see FIG. 9). According to a next block 124, the second end 92 of the inner sleeve 70 may be inserted through the central inner slot 68 of the expansion joint 28 until the first raised lip 72 of the expansion joint 28 rests on or is near the upper surface 96 of the first outer sleeve 84 (see FIG. 9).

The first vertical mullion 80 may be slid over the first outer sleeve 84 with the first outer sleeve 84 being received in the hollow slot 36 of the first vertical mullion 80 (block 126 and FIG. 10). At a block 128, the first raised lip 72 of the expansion joint 28 may be fit into the inner contour 34 of the first vertical mullion 80 (FIGS. 11-12). The second end 92 of the inner sleeve 70 may be inserted into the inner slot 88 of the second outer sleeve 86 until the second raised lip 74 of the expansion joint 28 contacts or is near the lower surface 98 of the second outer sleeve 86 (block 130), and the second outer sleeve 86 may be fastened to the second end 92 of the inner sleeve 70 (block 132) (see FIG. 9). At a block 134, the second vertical mullion 82 may be slid over the second outer sleeve 86 with the second outer sleeve 86 being received in the hollow slot 36 of the second vertical mullion 82 (see FIG. 10). The second raised lip 74 of the expansion joint 28 may then be inserted in the inner contour 34 of the second vertical mullion 82 according to a block 136 (see FIGS. 11-12). It will be understood that the method of FIG. 17 is exemplary and that the steps may be carried out in various orders in practice.

Figure 18:
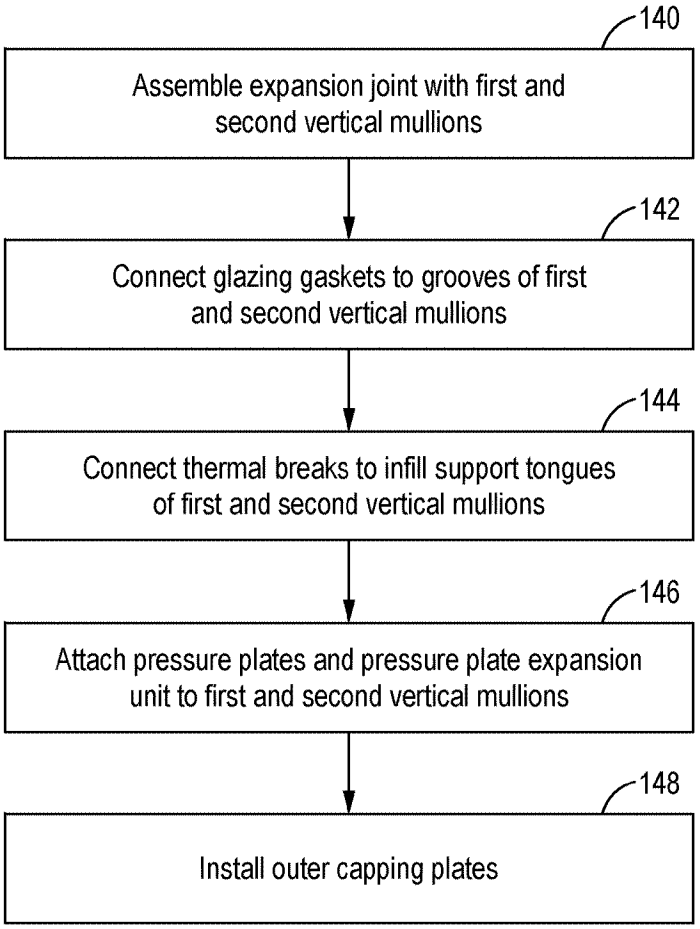
FIG. 18 is a flowchart of a series of steps that may be involved in assembling the vertical member of FIG. 2, in accordance with a method of the present disclosure.

FIG. 18 shows a series of steps that may be involved in assembling the vertical member 22 of the curtain wall 10. At a first block 140, the expansion joint 28 may be assembled with the first and second vertical mullions 80 and 82 as explained in detail above with reference to FIG. 17. At a block 142, the gaskets 50 may be connected to the grooves 40 of the first and second vertical mullions 80 and 82 (see FIG. 13). At a block 144, the thermal breaks 46 may be connected to the infill support tongues 44 of the first and second vertical mullions 80 and 82 (see FIG. 13). The pressure plates 48 and the pressure plate expansion unit 54 may be attached to the first and second vertical mullions 80 and 82 according to a block 146 (FIG. 13). Specifically, the pressure plates 48 may be attached to the mullions using the fasteners 106, and the pressure plate expansion unit 54 may be attached to the pressure plates 48 using the joint strap 104 and fasteners 106. At a block 148, the outer capping plates 52 may be installed on the vertical member 22 using methods apparent to those with ordinary skill in the art. It is noted that the method of FIG. 18 is exemplary, and the steps may be carried out in various order in practice. The assembly and installation of the remaining components of the curtain wall 10 such as the horizontal members and the infill panels 20 will be apparent to those with ordinary skill in the art.

The expansion joint and the pressure plate expansion unit disclosed herein permit movement of the vertical members of a curtain wall in response to deflection of the floor structures or other forces acting on the vertical members (e.g., wind, seismic forces, other building movements, etc.). The expansion joint and the pressure plate expansion unit are fabricated from compressible elastomeric materials, such as closed cell EPDM rubbers, that compress to a degree that allows greater movement of the vertical members than existing expansion joints. Applicants have found that the expansion joint disclosed herein, when assembled between the vertical mullions of a curtain wall, may accommodate up to ±15 millimeters of movement of building floor structures.

The pressure plate expansion unit assists in accommodating such movement. As such, the present disclosure provides curtain walls compatible with some newer building designs having higher floor structure deflection limits.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Although various example embodiments have been disclosed, a worker of ordinary skill in this art would recognize that certain modifications would come within the scope of this disclosure. For that reason, the following claims should be studied to determine the scope and content of this disclosure.

What is claimed is:

1. An expansion joint configured to connect first and second vertical mullions of a curtain wall, the first and second vertical mullions each including an elongated body having an inner contour defining a hollow slot and an infill support tongue extending from a side of the elongated body, the first and second vertical mullions including an inner sleeve extending through the hollow slot of both the first and second vertical mullions, the expansion joint comprising:

a body having sides, an upper surface, and a lower surface;

an inner contour defining a central inner slot extending through the body from the upper surface to the lower surface, the central inner slot being configured to receive the inner sleeve therethrough;

a first raised lip projecting from the lower surface of the body and being configured to be inserted inside of the inner contour of the first vertical mullion; and a second raised lip projecting from the upper surface of the body and being configured to be inserted inside of the inner contour of the second vertical mullion.

2. The expansion joint of claim 1, wherein the expansion joint is formed from a polymeric elastomer foam.

3. The expansion joint of claim 1, wherein the expansion joint is formed from a closed cell ethylene propylene diene monomer (EPDM) foam rubber sponge.

4. The expansion joint of claim 1, wherein the first raised lip and the second raised lip each circumscribe the central inner slot.

5. The expansion joint of claim 1, wherein the inner contour defining the central inner slot has a shape corresponding to an outer contour of the inner sleeve.

6. The expansion joint of claim 1, wherein:

the first raised lip is configured to form an interference fit with the inner contour of the first vertical mullion; and the second raised lip is configured to form an interference fit with the inner contour of the second vertical mullion.

7. The expansion joint of claim 1, wherein the expansion joint further comprises a projection extending from one of the sides of the body, the projection being configured to be inserted between the infill support tongues of the first and second vertical mullions when the expansion joint is assembled with the first and second vertical mullions.

8. The expansion joint of claim 7, wherein the expansion joint further includes a tab on either side of the projection, and wherein the tabs extend from the side of the body that includes the projection.

9. The expansion joint of claim 8, wherein the expansion joint further includes a support rod extending through at least one of the projection and the tabs.

10. A curtain wall for a building having floor structures, comprising:

a frame anchored to the floor structures and including a plurality of frame units composed of horizontal members and vertical members;

infill panels supported by the frame units;

vertical mullions forming the vertical members, each of the vertical mullions including an elongated body having an inner contour defining a hollow slot, and an infill support tongue extending from a side of the elongated body, the side of the elongated body further including a gasket;

an inner sleeve inserted through the hollow slots of an adjacent pair of the vertical mullions; and an expansion joint connecting the adjacent pair of the vertical mullions, the expansion joint comprising:

a body having sides, an upper surface, and a lower surface, an inner contour defining a central inner slot receiving the inner sleeve therethrough, a first raised lip projecting from the lower surface of the body and inserted inside of the inner contour of a first vertical mullion of the adjacent pair of the vertical mullions, and a second raised lip projecting from the upper surface of the body and inserted inside of the inner contour of a second vertical mullion of the adjacent pair of the vertical mullions, the expansion joint being formed from a compressible elastomeric material that allows the adjacent pair of the vertical mullions to accommodate deflection of the floor structures.

11. The curtain wall of claim 10, wherein the expansion joint is formed from a closed cell ethylene propylene diene monomer (EPDM) foam rubber sponge.

12. The curtain wall of claim 10, wherein the expansion joint is configured to allow the adjacent pair of vertical mullions to accommodate about 15 millimeters of deflection of the floor structures.

13. The curtain wall of claim 10, further comprising:

pressure plates assembled with the first and second vertical mullions; and a pressure plate expansion unit between the pressure plates, the pressure plate expansion unit being formed from a compressible elastomeric material that allows the adjacent pair of vertical mullions to accommodate the deflection of the floor structures.

14. The curtain wall of claim 13, wherein the expansion joint and the pressure plate expansion unit are each formed from a closed cell ethylene propylene diene monomer (EPDM) foam rubber sponge.

15. The curtain wall of claim 14, wherein the expansion joint and the pressure plate expansion unit are configured to allow the adjacent pair of the vertical mullions to accommodate about ±15 millimeters of deflection of the floor structures.

16. The curtain wall of claim 10, wherein:

the first and second vertical mullions each include an outer sleeve received in the hollow slot of the vertical mullion between the inner contour of the vertical mullion and the inner sleeve;

the first raised lip of the expansion joint is inserted between the inner contour of the first vertical mullion and the outer sleeve of the first vertical mullion; and the second raised lip of the expansion joint is inserted between the inner contour of the second vertical mullion and the outer sleeve of the second vertical mullion.

17. The curtain wall of claim 10, wherein the expansion joint further includes:

a projection extending from one of the sides of the body; and a tab on either side of the projection, the tabs being inserted between the gaskets of the first and second vertical mullions.

18. The curtain wall of claim 17, wherein the expansion joint further includes a support rod extending through at least one of the projection and the tabs.

19. The curtain wall of claim 10, wherein the expansion joint is positioned at a level of one of the floor structures.

20. A method of assembling vertical mullions of a curtain wall using an expansion joint, the expansion joint including a body, a central inner slot extending through the body, a first raised lip projecting from a lower surface of the body, and a second raised lip projecting from an upper surface of the body, comprising:

inserting a first end of an inner sleeve into an inner slot of a first outer sleeve;

inserting a second end of the inner sleeve through the central inner slot of the expansion joint;

sliding a first vertical mullion over the first outer sleeve;

fitting the first raised lip of the expansion joint into an inner contour of the first vertical mullion;

inserting the second end of the inner sleeve into an inner slot of a second outer sleeve;

sliding a second vertical mullion over the second outer sleeve; and fitting the second raised lip of the expansion joint into an inner contour of the second vertical mullion.

* * * * *